United States Patent [19]

Ashley

[11] 4,231,282

[45] Nov. 4, 1980

[54] IGNITION SYSTEM

[75] Inventor: Eugene Ashley, Burlington, Vt.

[73] Assignee: General Electric Company, Burlington, Vt.

[21] Appl. No.: 25,176

[22] Filed: Mar. 29, 1979

[51] Int. Cl.[3] ..... F41F 1/04
[52] U.S. Cl. ..... 89/7
[58] Field of Search ..... 89/7, 1 K, 1 R; 137/512.1

[56] References Cited

U.S. PATENT DOCUMENTS

| | | | |
|---|---|---|---|
| 3,202,055 | 8/1965 | Butler et al. | 89/7 |
| 3,576,103 | 4/1971 | Kahn | 89/7 X |
| 3,898,999 | 8/1975 | Haller | 137/512.1 |
| 4,033,224 | 7/1977 | Holtrop | 89/7 |
| 4,050,349 | 9/1977 | Graham | 89/7 |
| 4,051,762 | 10/1977 | Ashley | 89/7 |

*Primary Examiner*—David H. Brown

[57] ABSTRACT

A feature of this invention is the provision of a booster charge of liquid propellant from a main supply to adiabatically compress a quantity of gas and then progressively inject the booster charge into the heated gas.

7 Claims, 2 Drawing Figures

IGNITION SYSTEM

BACKGROUND OF THE INVENTION

1. Field of the Invention

This invention relates to an ignition system, utilizing adiabatic heating of gas, for liquid propellants.

2. Prior Art

Liquid propellant guns are well known, and are shown, for example, in U.s. Pat. No. 4,023,463, issued to D. P. Tassie, on May 17, 1977 and in U.S. Pat. No. 4,051,762, issued to E. Ashley, on Oct. 4, 1977. Such guns, firing non-hypergolic propellants, require an initial pulse of hot, high pressure gas in the combustion chamber to start the firing process for each shot. For repetitive firing, sequential pulses must be provided. When pyrotechnic primers are utilized, the expended primer must be replaced after each shot as shown in U.S. Pat. No. 4,051,762. Electric spark ignition will work only with electrically conductive propellants, as shown in U.S. Pat. No. 4,023,463. Non-conductive propellants, such as Otto Fuel II, cannot be easily ignited. They must be confined and exposed to conditions of sufficient temperature and pressure for combustion to occur. U.S. Pat. No. 3,576,103, issued to P. B. Kahn, on Apr. 27, 1971, shows ignition of a monopropellant by adiabatic compression. This is accomplished by compressing a preloaded volume of propellant by means of a spring-loaded plunger which must be manually cocked and seared for each shot.

An object of this invention is to provide a series of adiabatic ignition pulses for non-hypergolic propellants for burst firing.

Another object is to provide each such pulse with an extended, controlled duration.

A feature of this invention is the provision of a booster charge of liquid propellant from a main supply to adiabatically compress a quantity of gas and then progressively inject the booster charge into the heated gas.

BRIEF DESCRIPTION OF THE DRAWING

These and other objects, features and advantages of the invention will be apparent from the following specification thereof taken in conjunction with the accompanying drawing in which.

DESCRIPTION OF THE PREFERRED EMBODIMENT

Figure 1:
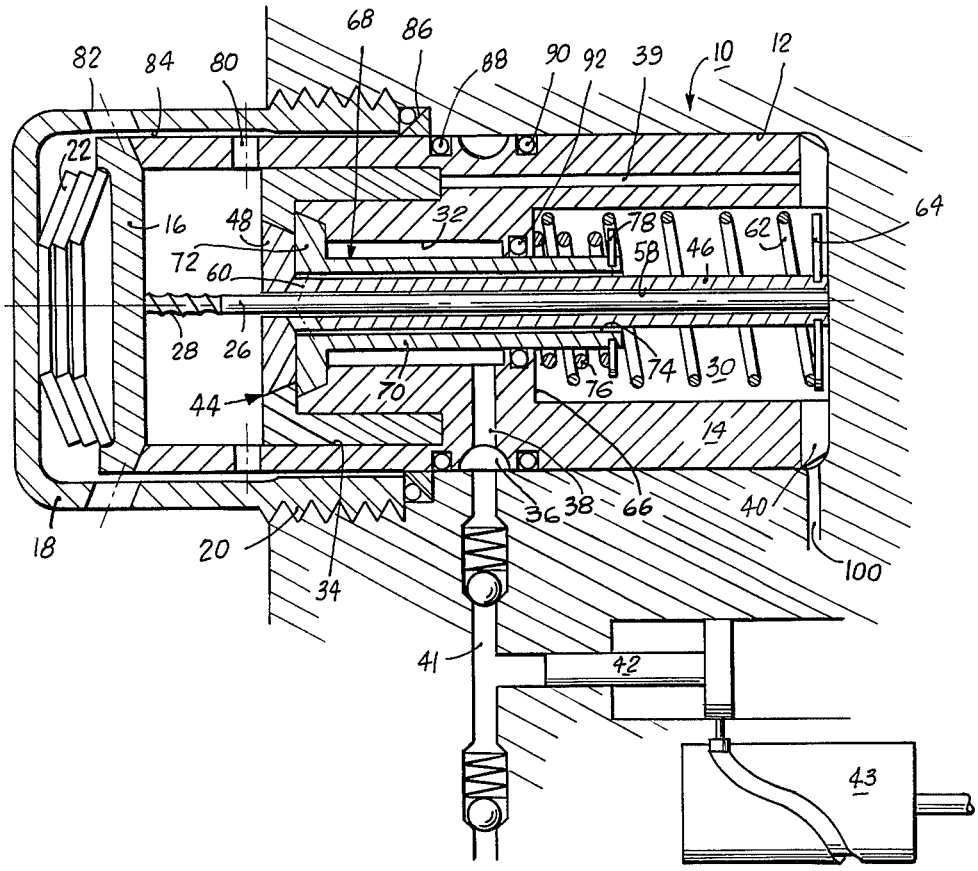
FIG. 1 is a longitudinal cross-section of an ignition system embodying this invention.

An ignition system for liquid propellants which uses adiabatic compression of air or gas as the initiating source of combustion is shown in FIG. 1.

A housing 10 of a gun has a main combustion chamber with bore 12 in which is disposed in part a main body 14 of the igniter. A relief cap 16 is disposed on the projecting end of the body. A retaining cap 18 is threaded at 20 into the bore 12 and presses a plurality of belleville washers 22 against the relief cap 16 to seat the body 14 in the bore 12. A valve rod 26 is fixed to the relief cap 16 and has a helical or other shaped relief groove 28 therein adjacent to said cap.

The valve body includes a longitudinally extending bore portion 30 of relatively large diameter, a longitudinally extending bore portion 32 of relatively small diameter, a longitudinally extending annular recess 34, an annular groove 36, a radially extending bore, or bores, 38 coupling said groove 36 and said bore portion 32, and a longitudinally extending, fine bore, or bores, 39 coupling said recess 34 with a plurality of radial grooves 40.

Figure 2:
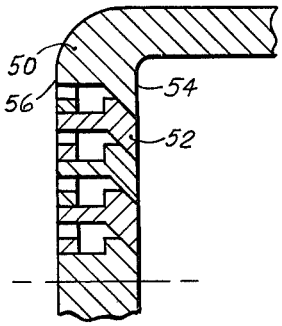
FIG. 2 is a detail of the structure of the differential piston of the ignition system of FIG. 1.

A supply line 41 for liquid propellant is coupled to the annular groove 36. An injection piston 42 is coupled to the line 41 to meter a quantity of propellant through the bore 38 into the bore portion 32. The piston may be driven by suitable periodic drive means, such as a cam 43 or a crank rod (not shown). A differential piston assembly 44 has a rod 46 and multipart head 48. The head 48 is shown schematically in FIG. 1 and in greater detail in FIG. 2, and is constructed in accordance with Ser. No. 2,038, filed Jan. 8, 1979 by E. Ashley. The head 48 has a relatively larger working area to its ignition chamber adjacent, or forward, face, and a relatively smaller working area to its supply chamber adjacent or aft face, and includes an outer annular sleeve 50 supporting one or more inner annuli 52. The parts are interfitted and normally biased closed by the difference in pressure on the two faces of the piston head augmented by the force of the spring 62, but permit limited relative movement to provide passageways through the head from the aft face 54 to the forward face 56 when the force on the aft face is greater than the force on the forward face, i.e., the equivalent of a plurality of poppet valves. The rod 46 and the head 48 have a longitudinal bore 58 therethroug in which is journaled the stationary valve rod 26. A plurality of radially extending spray bores 60 extend through the piston rod 46 to the bore 58. A helical spring 62 is captured between a clip 64 fixed to the aft end of the piston and a shoulder 66 on the bore portion 30, and serves to bias the piston aft.

A unidirectional flow or check valve 68 has a valve rod 70 and a head 72 with a longitudinally extending central bore 74 in which is journaled the piston rod 46. The check valve is of the type shown in U.S. Pat. No. 4,023,463, issued May 17, 1977, to D. P. Tassie. A helical spring 76 is captured between a clip 78 fixed to the aft end of the valve rod and the shoulder 66.

A plurality of radial holes 80 are provided through the tubular wall of the body immediately forward of the piston head, when the piston head is in its aftmost position.

A plurality of radial holes 82 are provided through the tubular wall of the retaining fitting 18 aligned with the interface of the relief cap 16 and the body.

An annular gap 84 is provided between the outer cylindrical surface of the body and the inner cylindrical surface of the retaining fitting in the region between the holes 80 and 82.

Ring seals are provided at 86, 88, 90 and 92.

Liquid propellant is forced through the bore 38 into the bore portion 32 by the injection piston 42 at high pressure. The liquid shifts the check valve and the differential piston forwardly, so that liquid passes through the developed gap between the head of the check valve and the body against the aft face of the head of the differential piston. The pressure on the aft face of the head is greater than the pressure on the forward face, maintaining the rings of the piston head closed together.

As the differential piston moves forwardly it closes off the holes 80, trapping gas between the front face of the differential piston and the relief cap 16, which with the adjacent inner wall of the body, define an ignition chamber. Before the first shot, the gas will be air, but after firing the gas will be a mixture of air and combustion products. Continuing forward movement of the differential piston, against the bias of its spring, under the influence of the entering high pressure liquid from the injection piston, continues to compress the gas. This movement is rapid so that a minimum of heat is lost to the walls, and a maximum of heat is retained by the compressed gas. This forward movement and gas compression continue until the holes 60 come over the helical relief groove 28 on the stationary valve rod. Liquid pressure is higher than gas pressure, by Pascal's Law, and liquid propellant is forced through the holes 60 and the relief groove into the combustion chamber. The groove is designed to discharge the liquid propellant as a spray into the combustion chamber where it contacts the hot compressed gas therein and ignites.

As soon as this liquid propellant begins to burn in the confined combustion chamber, the pressure of the gas in the combustion chamber will rise. When the force developed by the gas pressure forward of the piston head exceeds the force developed by liquid pressure aft of the piston head, regenerative action begins. The rings of the piston head open and the piston head and the check valve head move aft, initially closing the check valve. The charge of liquid propellant trapped forward of the check valve is progressively injected through the open rings of the differential piston head into the combustion chamber as the differential piston head is forced aft by the combustion gas pressure. The holes 80 through which the air originally entered will not be exposed and opened until the differential piston has almost completed its aftward stroke. The high temperature combustion gas is passed out of the combustion chamber, to ignite the main charge of liquid propellant in the gun, when the combustion gas pressure becomes sufficiently high to compress the bellevile washers 24 to unseat the relief cap 16 to allow the combustion gas to flow out through the holes 82. This occurs before the completion of the differential piston stroke, and as the differential piston continues its aftward movement, a sustained pulse of ignition gas is passed out through the holes 82.

The fine bore 39 and the groove 40 provide a vent to allow leakage to be relieved to a passageway 100 in the housing 10 of the gun, which opens to atmospheric pressure. This vent also serves to provide the differences in area between the front and the rear faces of the differential piston head.

The advantages of this igniter may be recapitulated as:

1. No pyrotechnic primer or electrical firing pulse is required to initiate ignition.
2. The ignition charge of liquid propellant can be repetitively and accurately metered into the igniter.
3. The regenerative piston provides a prolonged flow or pulse of ignition gas for ignition of the main liquid propellant charge.
4. Any convenient mechanical or hydraulic means can be used to repetitively provide the initiating liquid injection pressure.

I claim:

1. An ignition system for liquid propellant comprising:

a first chamber;

a piston having a head disposed in said first chamber and dividing said first chamber into an ignition chamber and a liquid propellant supply chamber;

means for admitting gas into said ignition chamber;

unidirectional flow valve means for admitting liquid into said supply chamber and for blocking loss of liquid therefrom;

means for providing under pressure a predetermined quantity of liquid propellant through said unidirectional flow valve means into said supply chamber, whereby said liquid propellant causes translation of said head of said piston in a first direction to enlarge the volume of said supply chamber and to decrease the volume of said ignition chamber, to compress and thereby heat the gas;

first means effective upon the translation of said head to a predetermined minimal volume of said ignition chamber for passing an initial quantity of liquid propellant from said supply chamber into said ignition chamber for ignition by the therein compressed and heated gas, whereby the ignited liquid propellant provides an increase in gas pressure in said ignition chamber and causes translation of said head of said piston in a second direction opposite to said first direction to enlarge the volume of said ignition chamber and to decrease the volume of said supply chamber; and second means effective upon the translation of said head in said second direction to progressively pass the remaining quantity of liquid propellant from said supply chamber to said ignition chamber during the course of movement in said second direction of said head.

2. An ignition system according to claim 1 wherein:

said gas admitting means includes additional means for providing a passageway into said ignition chamber;

said additional means being open when said head of said piston defines the minimum volume of said supply chamber; and said additional means being closed when said head of said piston defines significantly more than the minimum volume of said supply chamber.

3. An ignition system according to claim 1 further including:

means for regularly, periodically operating said liquid propellant providing means.

4. An ignition system according to claim 1 wherein:

said head of said piston has a face adjacent said ignition chamber of a relatively larger working area and a face adjacent said supply chamber of a relatively smaller working area.

5. An ignition system according to claim 4 wherein:

said second means includes means for providing a passageway through said head of said piston from said supply chamber adjacent face to said ignition chamber adjacent face;

said passageway means being closed when the pressure applied to said supply chamber adjacent face is higher than the pressure applied to said ignition chamber adjacent face; and said passageway means being open when the pressure applied to said supply chamber adjacent face is lower than the pressure applied to said ignition chamber adjacent face.

6. An ignition system according to claim 1 further including:

means for venting ignited liquid propellant from said ignition chamber.

7. An ignition system according to claim 6 wherein:

said venting means includes yet additional means for providing a passageway from said ignition chamber;

said yet additional means being closed when the pressure in said ignition chamber is below a predetermined value; and said yet additional means being open when the pressure in said ignition chamber is above a predetermined value.

* * * * *